United States Patent [19]

Schönfeld et al.

[11] Patent Number: 4,706,898

[45] Date of Patent: Nov. 17, 1987

[54] CRUSHING MACHINE WITH A REMOVABLE OUTLET GRATE

[75] Inventors: Joachim Schönfeld, Willich; Hans-Günter Lapp, Ratingen; Gabriele Greiner, Monchen-Gladbach, all of Fed. Rep. of Germany

[73] Assignee: Lindemann Maschinenfabrik GmbH, Fed. Rep. of Germany

[21] Appl. No.: 867,911

[22] Filed: May 27, 1986

[30] Foreign Application Priority Data

May 31, 1985 [DE] Fed. Rep. of Germany ..... 3519516

[51] Int. Cl.[4] ..... B02L 13/02

[52] U.S. Cl. ..... 241/73; 241/84; 241/189 R; 241/285 A; 241/285 B

[58] Field of Search ..... 241/73, 74, 84, 84.1, 241/84.2, 84.3, 84.4, 185 R, 189 R, 189 A, 285 R, 285 A, 285 B, 88.4

[56] References Cited

U.S. PATENT DOCUMENTS

| | | | |
|---|---|---|---|
| 17,334 | 6/1929 | Liggett | 241/88.4 X |
| 1,170,389 | 2/1916 | Armstrong | 241/88.4 X |
| 2,141,664 | 12/1938 | Ossing | 241/88.4 |

FOREIGN PATENT DOCUMENTS 2523746 9/1982 Fed. Rep. of Germany .

*Primary Examiner*—Timothy V. Eley

*Attorney, Agent, or Firm*—Toren, McGeady & Associates

[57] ABSTRACT

For the rapid replacement of an outlet grate in a crushing machine and for adapting the crushing operation to different types of materials, an outlet grate is located within the crushing machine housing extending generally horizontally between a pair of opposite walls. An opening is provided in at least one of the opposite walls in the region of the grate and the grate can be removed in whole or in part through the opening.

11 Claims, 12 Drawing Figures

CRUSHING MACHINE WITH A REMOVABLE OUTLET GRATE

BACKGROUND OF THE INVENTION

The present invention is directed to a crushing machine including a housing having an inlet for the material to be crushed, a pair of opposite walls forming a part of the housing with a horizontally arranged rotor including crushing tools extending between the opposite walls, and a replaceable outlet grate with grate rods extending parallel to the axis of the rotor and located below the rotor.

A crusher of the general type mentioned above is disclosed and illustrated in U.S. Pat. No. 2,450,492. The grate extends around and below the lower half of the rotor. For maintenance purposes, the grate, made up of parallel rods extending in the axial direction of the rotor, can be removed in halves on rails out of the housing. Apart from the complicated and relatively expensive rail guided arrangement for the grate, the removal of the grate to the sides of the housing involves considerable problems in view of the auxiliary components, such as supply and removal devices, dust removal means, viewing means and supports. Further, adaptation of the grate for a different type of material is not possible with the known grate arrangement.

In German Offenlegungsschrift No. 21 46 362 another crushing machine is disclosed for processing household garbage with a grate located in the lower part of the machine housing. A disadvantage of this known crusher is that for maintenance or repair on the grate or for replacement of the grate in the event there is a change in the type of material being processed, initially the upper housing half must be tilted out of position so that the rotor supported in the lower part of the housing can be removed before the grate is accessible and can be lifted upwardly toward the top of the machine.

This known crusher has both a cumbersome and expensive design. A disadvantageous factor in this known arrangement is that it requires several different operations before the grate can be replaced, that is, opening of the housing, removal of the rotor and the performance of safety measures required in connection with such operations. An adaptation for use with different materials is impossible with this particular crusher.

In U.S. Pat. No. 4,129,260 another crusher arrangement is known having a screen cage which is complicated to disassemble. The screen cage is axially displaceable out of the housing. For the removal of the screen cage out of the housing, however, a housing cover must be removed and at the same time the rotor is supported so that to replace the cover all of the support parts for the rotor must be released. Further, in this arrangement the rotor must be removed. The screen cage is accessible for maintenance only after the rotor is removed. A disadvantageous feature of this complicated and non-adaptable arrangement is, that it is severely limited by the required removal of the rotor supported in the housing cover.

SUMMARY OF THE INVENTION

The primary object of the present invention is to provide a crusher of the type described above in which rapid grate replacement is possible and the grate can be adapted for handling different types of material to be crushed without requiring any appreciable disassembly of the crusher.

In accordance with the present invention, at least one of the walls of the housing between which the crushing rotor extends has an aperture or opening in the region of the outlet grate with the grate supported in the opening and the grate can be replaced at whole or in part through the opening. Preferably, the opening has a sickle-like or partly arcuate shape.

Since the drive for the rotor is located at one of the housing walls, the opposite wall affords the removal of the outlet grate in a surprisingly simple manner. Depending on the type of material to be crushed or comminuted, such as household waste, wood, and the like, it is possible to remove the grate either in whole or in part where its individual grate rods can be removed and replaced in a simple manner with the manufacturing technology or economic considerations determining the grate construction. For the replacement of the outlet grate, the support of the grate in a pair of opposite walls of the housing has a very favorable effect, because direct access to the grate is available and does not require any complicated removal or disassembly of other machine components.

In one preferred embodiment of the invention, at least one web secured in the opposite walls of the housing extends in the vertical plane containing the rotor axis whereby a single grate rod can be removed without requiring the removal of all of the other grate rods located in front of it. By subdividing the lower part of the crushing space in the housing into two or more sections by means of the web, considerably fewer grate rods have to be removed than would be the case in a housing which is not sub-divided. Such web or webs thus afford a support or fastener for the rods making up the grate. Since the removal and installation of relatively heavy grate rods may result in handling problems for the crusher operating personnel, it is possible, in accordance with another embodiment of the invention, where the outlet grate is divided into individual replaceable grate rods, each grate rod, at least at one end, and preferably in the region of the opening through which the grate is removed, can have a stepped projection extending from the housing. Such an arrangement of the grate rods limits the axial displaceability when the stepped projection bears against the inner surface of the housing wall.

By handling the grate rods at the protruding projection, the replacement of the individual rods is considerably simplified Moreover, at the stepped projection, the rod can abut in the opening of the housing so that during operation the individual grate rods are secured against axial shock.

The opening in the housing wall used for replacing the outlet grate can be closed by at least one cover section so that the grate rods are protected against axial shock and from being displaced out of position in the event plain ended grate rods are used.

Improved protection of the individual grate rods is possible, in accordance with the present invention, by providing projecting sections on the cover extending into overlapping engagement with the ends of the grate rods in the opening through the housing wall.

To avoid the effect of forces which tend to lift the grate rods, such as caused by the forces generated by the rotation of the rotor, in a preferred embodiment where the grate rods have plain ends, each replaceable grate rod has an engagement groove in at least one of its ends so that a projecting section on the cover can engage within the groove as it extends inwardly through the opening in the housing wall. If the outlet grate is to be placed so that a different width is afforded, due to a change in the characteristics of the material being crushed or a change in the required size of the crushed material, in accordance with another feature of the invention, all of the grate rods or only a portion of the rods can be replaced. Since each replaceable grate rod has at least two spacer members attached to it for determining the spacing between adjacent rods the shape of the spacer members determines the width of the gap between adjacent rods and also the shape of the gap which has an effect on the impact and/or the striking angle. The different shape and dimensions of the spacer members affords space for additional handling possibilities and has a direct influence on the gap width, the gap shape and the relevant impact or striking angle.

By changing the inclined position of the individual grate rods, based on the oblique shape of the spacer members of the adjacent grate rod, the impact angle can fall below 90° forming an acute angle so that the gap width between the grate rods increases. Due to this feature involving the shape of the spacers or due to the oblique positioning of the grate rods, it is possible depending on the type of material to be comminuted, such as bark and wood, to achieve an improved comminution with an increased output and at the same time prevent blockage of the outlet grate where moist materials are being processed.

To eliminate, as much as possible, the effect of negative forces, in another embodiment of the present invention, the replaceable grate rods are secured against rotation in the circumferential direction of the rotor by at least one fixed abutment member extending in the axial direction of the rotor and against which the adjacent rod of the grate abuts.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which where are illustrated and described preferred embodiments of the invention.

DETAILED DESCRIPTION OF THE INVENTION

Figure 1:
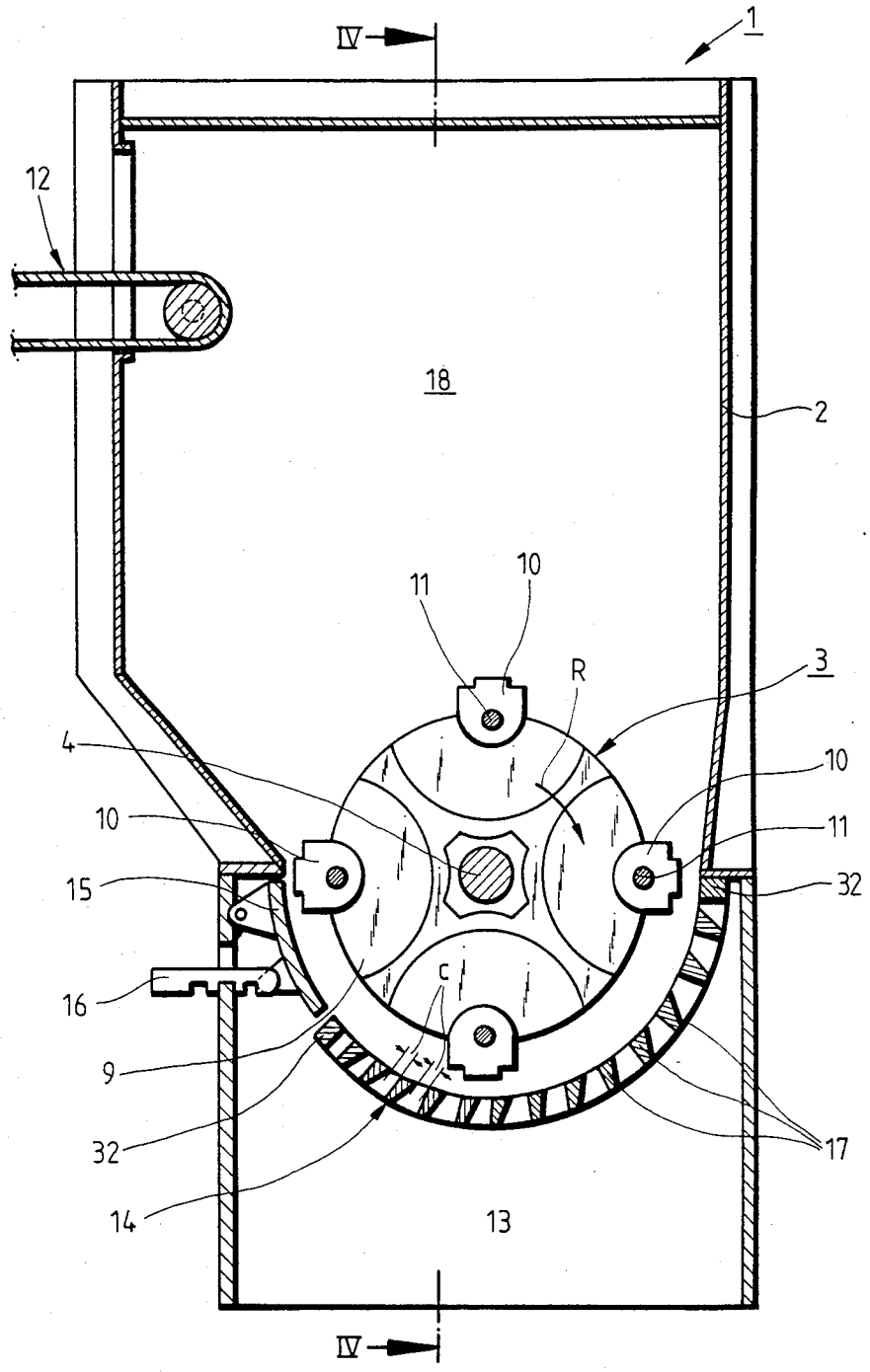
FIG. 1 is an elevational cross-sectional view through a crushing machine embodying the present invention.

In the drawing a crushing machine 1 is displayed including an upwardly extending housing 2 forming a crushing space. In the lower part of the housing a crushing rotor 3 is supported for rotation in the direction R around a horizontal axis 4 supported on opposite sides of the housing in bearings 7, 8 each located within a bearing block 5, 6. Crushing rotor 3 is formed by a plurality of rotor discs 9 extending transversely of and spaced apart on the axis 4. Crushing tools 10 are mounted on axles 11 and are located between adjacent rotor discs 9 with the axles 11 spaced radially outwardly from and parallel with the axis 4 of the rotor 3. The axis or shaft 4 of the rotor 3 is connected by a clutch to a drive unit, not shown. Due to the arrangement of the crushing rotor 3 shown in FIGS. 4 and 5, grate rods 21 or an outlet grate 14 formed by the rods are uniformly swept by the crushing tools 10 and apart from the uniform comminution of the material to be crushed there is also a reduction in the wear and a decrease in the downtime due to required grate changes as a result of wear.

Figure 2:
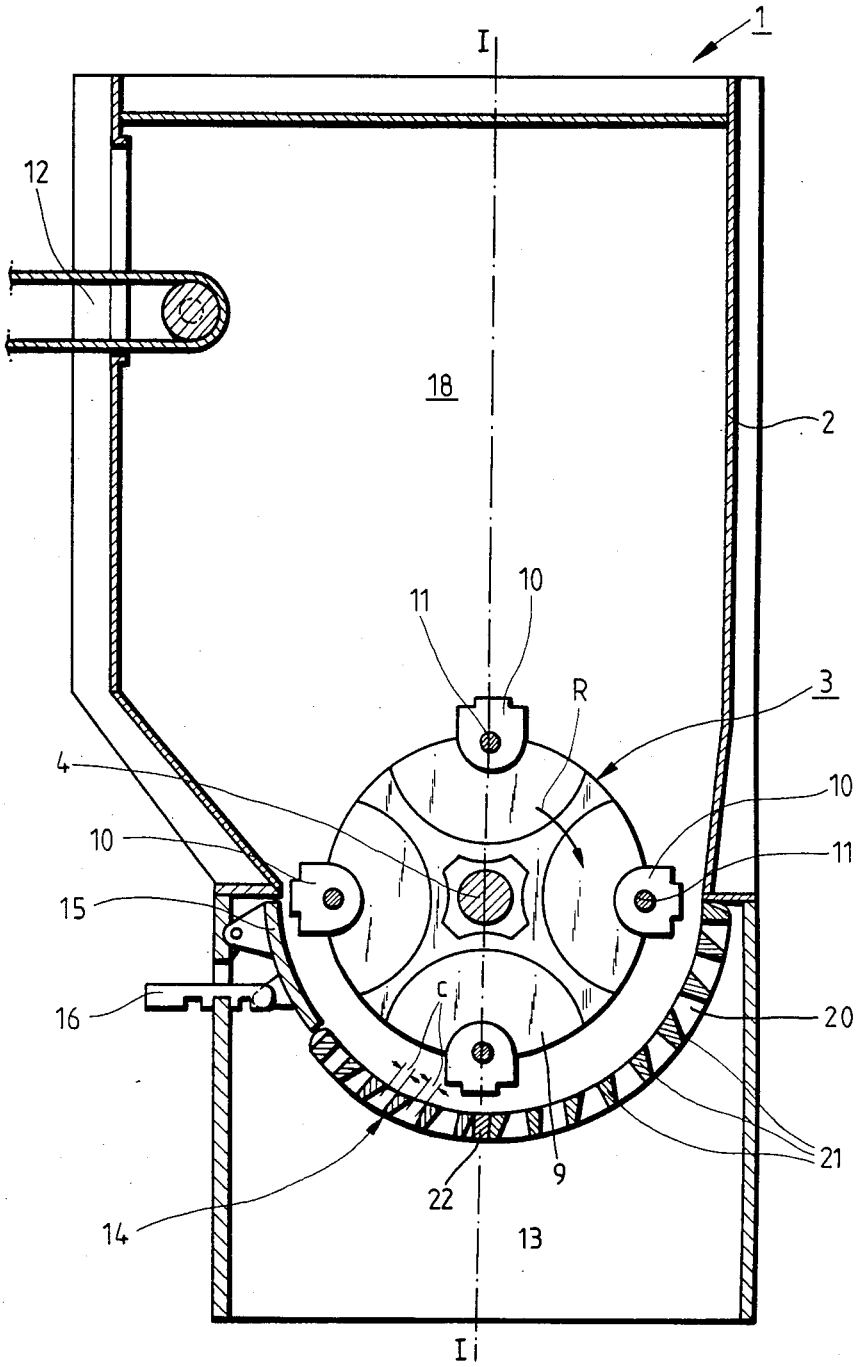
FIG. 2 is a view similar to FIG. 1 showing another embodiment of the present invention with a web extending in the axial direction of the rotor located approximately in the vertical plane of the rotor axis.

A material inlet 12 is located in the upper part of the housing opening into the crushing space above the rotor 3 and a material outlet 13 is located at the lower end of the housing 2 below the outlet grate 14. Material inlet 12 is located above and on the side of the crushing rotor 3 where the rotor rotates upwardly about the axis or shaft 4. Material outlet 13 is covered by the outlet grate 14 and by an end flap 15 extending circumferentially upwardly from the downstream end of the grate 14 in the rotational direction of the rotor 3. The end flap 15 serves for effecting the size of the material being crushed as well as for the removal of material which clogs or blocks the outlet grate. End flap 15 can be alternatively displaced either mechanically or hydraulically by a handle 16 formed with detents, as can be seen in FIGS. 1 and 2. The different positions of the end flap 15 are selectable in accordance with the position of the handle 16 secured to the wall of the housing 2. Outlet grate 14, as shown in FIG. 1, is made up of grate rods 17 supported on the opposite side walls of the housing, that is, the walls which support the rotor 3. The grate 14 is spaced closely radially outwardly from the crushing tools 10 for effecting the desired crushing action. At least one of the side walls 18, 19 of the housing supporting the grate rods 17 has, in the region of the crosssectional shape of the grate, an aperture 20, note FIGS. 3, 4 and 5. The grate 14 or grate rods 17 are supported in the opening or aperture 20 so that the grate can be replaced in whole or in part in the axial direction of the rotor 3. As shown in the drawing, the opening 20 has a sickle-like or arcuate segment shape.

By subdividing the outlet grate 14 into individually replaceable grate rods 21, as shown in FIG. 2, a web 22 is anchored in the opposite side walls 18, 19 of the housing and extends in the axial direction of the rotor 3 approximately in the vertical plane I—I of the rotor axis 4. With this arrangement, when an individual grate rod 21 is to be replaced, the preceding grate rods do not have to be replaced. By dividing the grate 14 within the housing 2 by the web 22, the number of grate rods 21 required to be removed in the event a replacement is necessary, is considerably reduced. Further, the number required to be removed can be further reduced by the use of additional webs.

Figure 5:
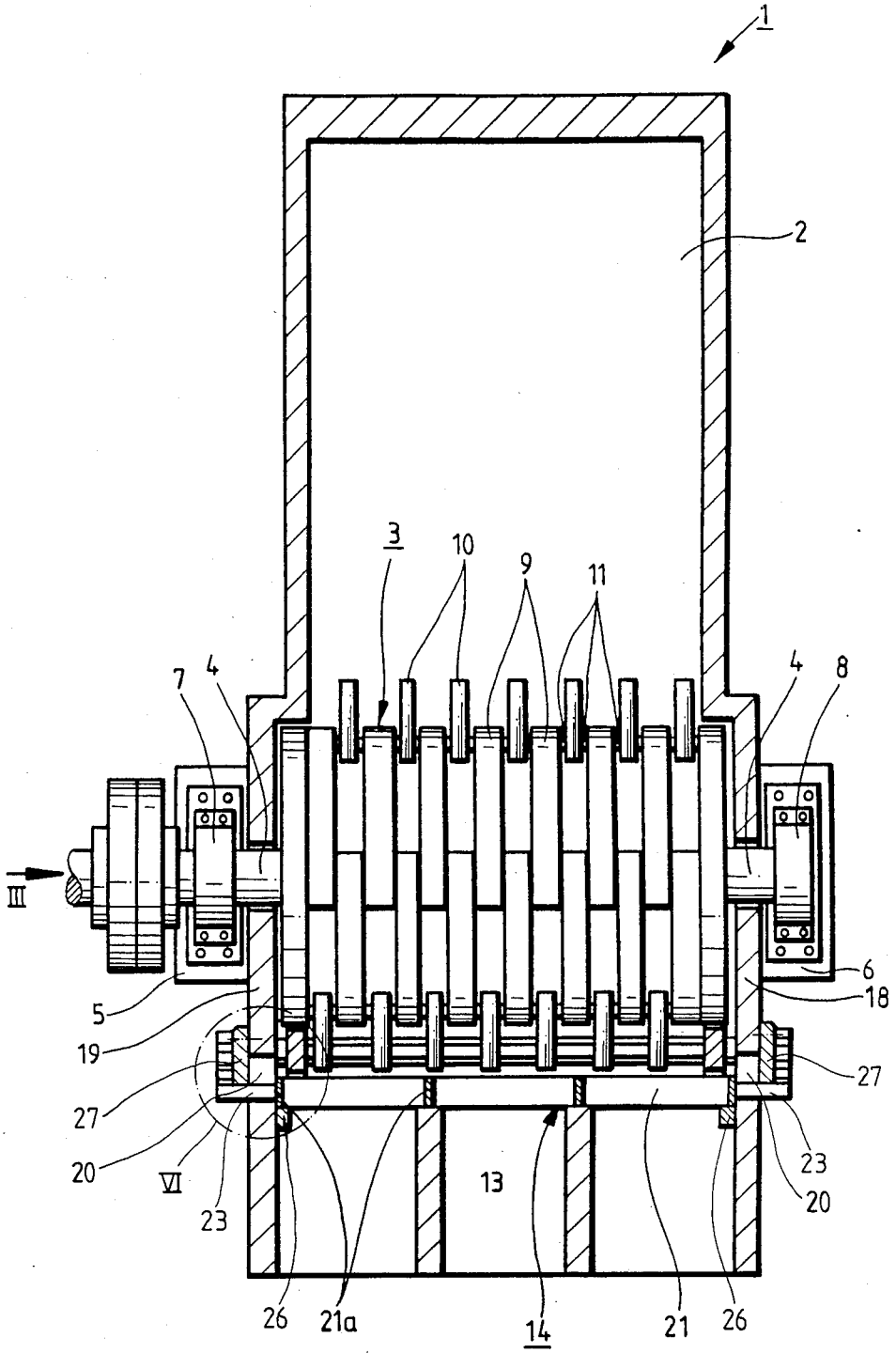
FIG. 5 is a cross-sectional view similar to FIG. 4 of another embodiment of the invention with a grate rod provided with a stepped projection section at its ends and with an opening in the housing wall aligned with the grate rod and closed by a cover.
Figure 6:
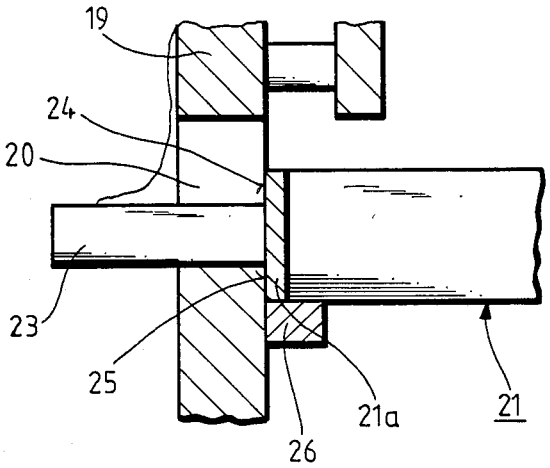
FIG. 6 is an enlarged sectional view of the encircled portion VI—VI in FIG. 5.
Figure 6A:
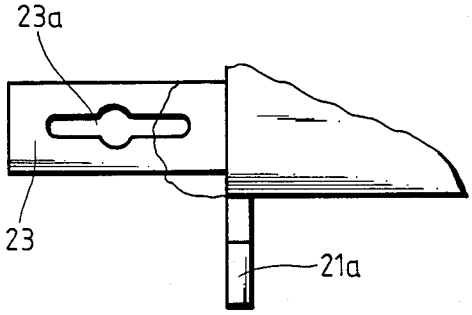
FIG. 6*a* is a plan view of the part of the crushing machine shown in FIG. 6.

The individually replaceable grate rods 21 can be formed, at least at one end, that is, the end at the opening through which the replacement is effected, with a stepped projection part extending through the housing 2 so that a stepped surface 24 bears against the inner surface 25 of the side wall 18, 19 of the housing 2 for limiting the displaceability of each grate rod 21 in the axial direction of the rotor, note FIGS. 5, 6 and 6*a*. The removal and installation of the individually replaceable grate rods can be further simplified by a tool recess in the shape of a groove 23*a* extending in the long direction of the rods, note FIG. 6*a*. As shown in FIG. 6*a* the center of the elongated hole or opening 23*a* is widened by a bore. With the opening 23*a* formed in the projection part 23 the simplified handling of the grate rods 21 is improved, since it is possible to insert a T-shaped wrench through the opening 23*a* and to rotate the wrench so that individual grate rods can be lifted and removed from the grate. For additional support or stabilization of the individual grate rods 21, support blocks or a support ledge 26 can be provided at the inner surface 25 of the walls 18, 19 of the housing 2, note FIG. 6 where the support ledge 26 bears against one surface of the grate rod 21.

Figure 3:
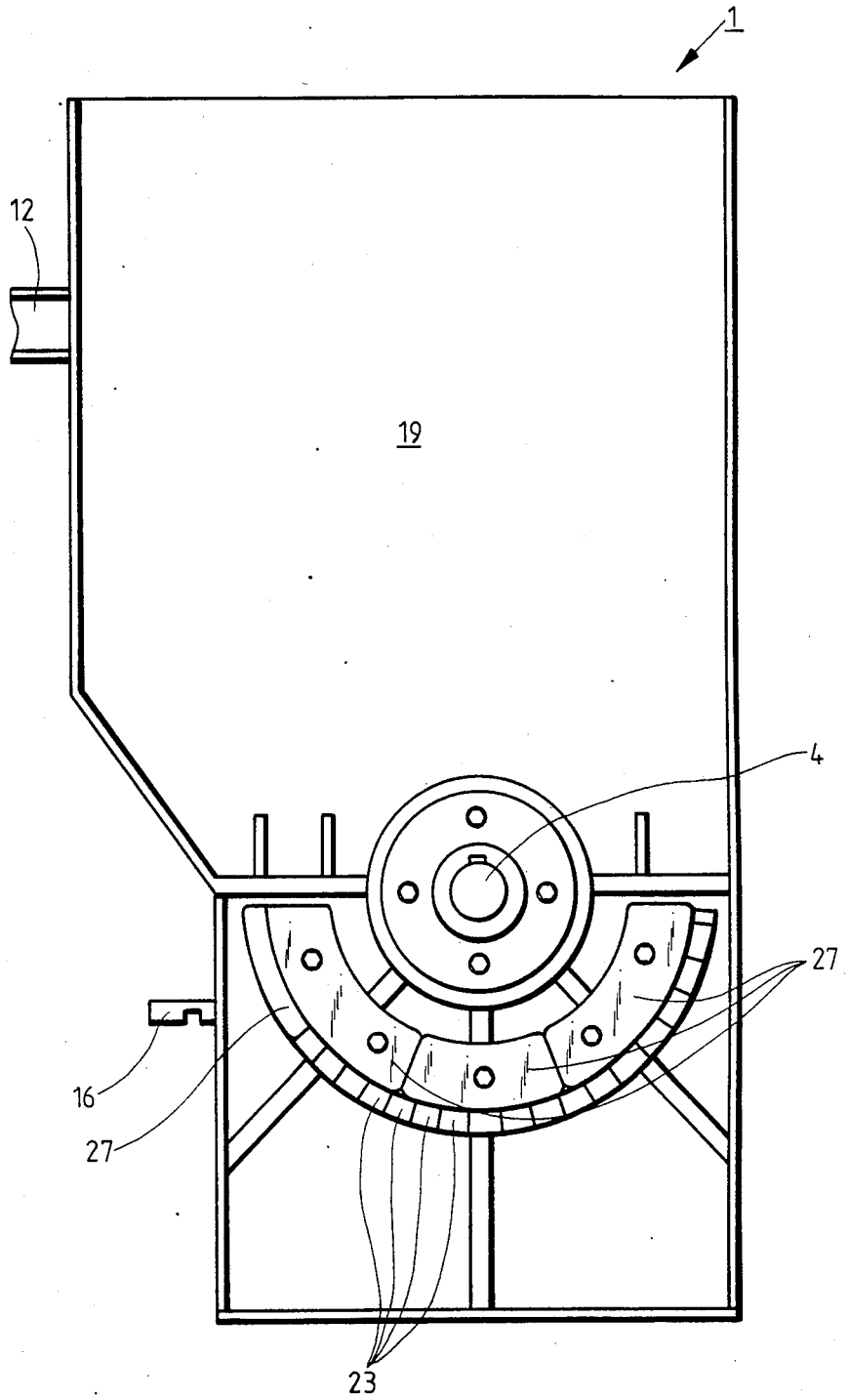
FIG. 3 is an elevational view of a crushing machine viewed in the direction of the arrow III in FIG. 5.
Figure 4:
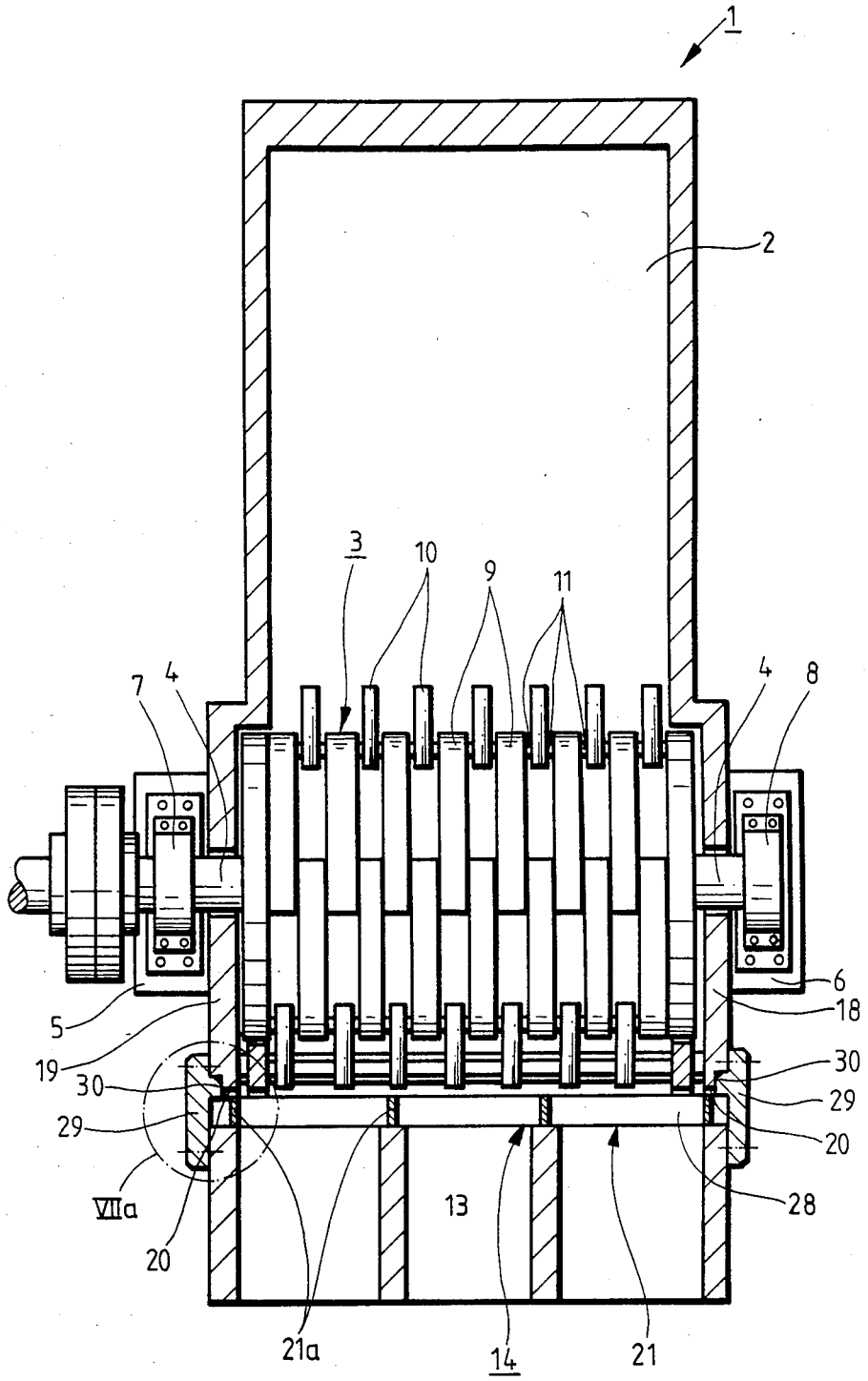
FIG. 4 is a cross-sectional view taken along lines IV—IV in FIG. 1 with a grate rod with plain ends and with an opening for the grate rod closed by a cover.
Figure 7A:
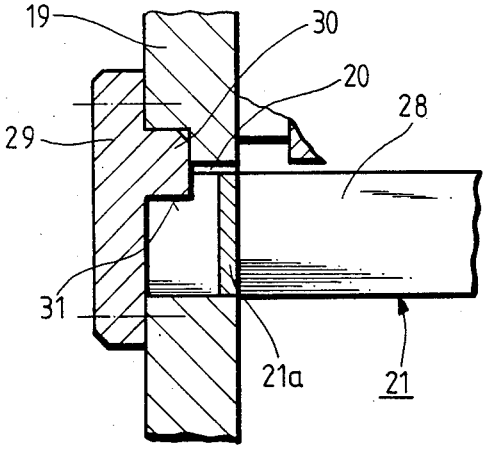
FIG. 7*a* is an enlarged sectional view of the encircled section VIIa in FIG. 4.
Figure 7B:
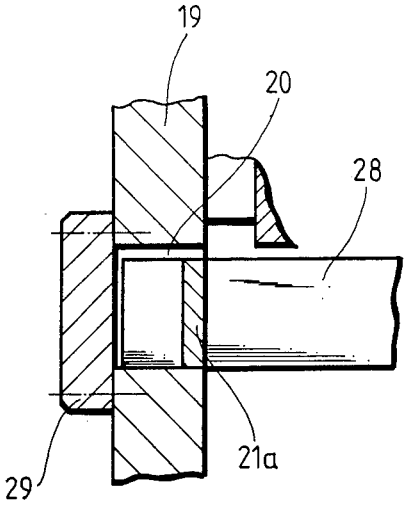
FIG. 7*b* is a view similar to FIG. 7*a*, however, with the grate rod having a plain end and with a cover secured to the opening in which the rod is supported.

To protect the grate rods 21 from undesirable effects of forces such as caused by the upwardly rotating rotor 2 which can cause movement or displacement of the individually replaceable grate rods 21 in the direction in which the rotor rotates, a cover 27 can be secured on the outside surface of the side walls 18, 19 of the housing 2, note FIGS. 3 and 5. The cover 27 presses against the outwardly extending projection parts 23 and retains the individually replaceable grate rods in position. In the embodiment set forth in FIG. 3, the cover 27 is divided into three sections rather than a single section. It would be possible to provide other shapes of the cover as compared to the cover 27 which has its inside surface flush with the opening in the side walls of the housing. As an example, a cover 29 could be used with the stepped ends of the grate rods such as displayed in FIGS. 4 and 7*a*. Other embodiments of the end configuration of the replaceable grate rods are illustrated in FIGS. 4 or 7*a* and 7*b*. A grate rod 28 is provided with a plain end, that is, it is not stepped, which can be secured against axial displacement by a cover secured on the outside surface of the side walls 18, 19 of the housing 2 as displayed in FIG. 4. Cover 29 is provided with an inwardly directed projection part 30 overlapping the grate rod and extending into a stepped opening 20 in the side wall 18, 19 of the housing. Instead, the cover could have a planar inside surface in contact with the outside surface of the side wall 18, 19 as depicted in FIG. 7*b*, so that the opening 20 is closed and the end of the grate rod 28 extends up to the cover whereby axial displacement of the grate rod is prevented. To secure such plain ended grate rods 28 against other force effects, such as would tend to lift the grate rod off its seat, each replaceable grate rod 28 can be provided at one of its ends with an engagement recess or groove 31 which engages with the projection part 30 formed on the inside surface of the cover 29 and extending into the opening 20 in the side walls 18, 19. In addition, the individually replaceable grate rods are protected from displacement in the rotational direction of the rotor by a rigidly fixed abutment ledge or member 32 extending in the axial direction of the rotor at the upstream end of the grate relative to the rotational direction R of the rotor, note FIG. 1. The grate rods 21 disposed in spaced relationship abut against one another with the downstream one of the grate rods bearing against the abutment ledge 32.

Figure 8A:
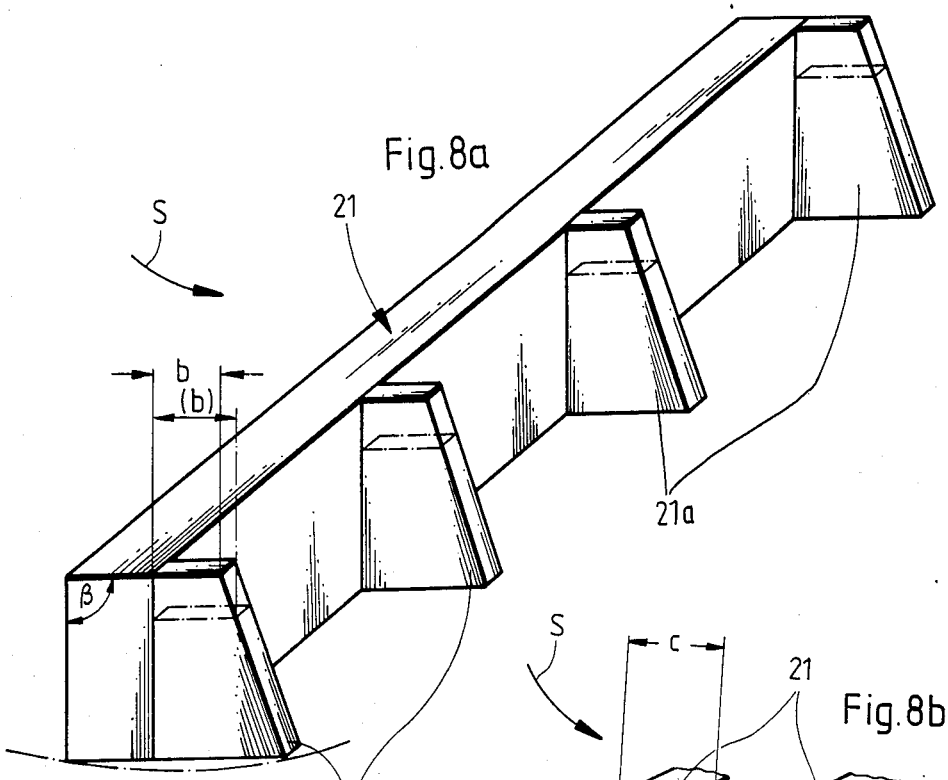
FIGS. 8*a*–8*c* are perspective views showing, on an enlarged scale, a grate rod with a plain end formed in accordance with the present invention.
Figure 8B:
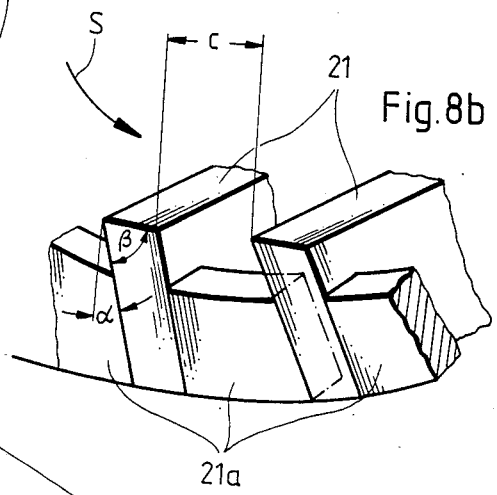

Each of the individually replaceable grate rods can be provided with at least two spacers 21*a* depending on the size or length of the grate rods, that is, the dimension extending in the axial direction of the rotor. Additional spacers 21*a* could be arranged as shown in FIGS. 8*a* and 8*b*. As illustrated, the edge of the spacers 21*a* spaced from the grate rods 21 is inclined at an angle to the surface of the grate rod from which the spacer extends. It can also be possible, however, to provide a spacer 21*a* of rectangular cross-section, not shown. The individually replaceable grate rods 21 are maintained in spaced relation by the spacers 21*a*. The distance or spacing between the individual grate rods 21 is determined by the upper dimension b of the spacers 21*a*, note FIG. 8*a*. By the selection of this dimension b and with the corresponding spacing of the grate rods, any desired grate gap width c can be established. By varying the shape of the spacers 21*a*, a variety of gap spaces can be established and the impact or striking angles $\alpha$ or $\beta$ can be produced. It is possible to vary the impact angle $\beta$ so that it forms an acute angle less than 90° by the oblique positioning of the grate rods and the spacers 21*a* as displayed in the embodiment in FIG. 8*a* with the resultant variation in the gap shape or gap width c. With these variations, changes in the degree of crushing are possible and a more favorable resistance moment can be set up in opposition to the material striking against the grate rod aligned at an acute angle and located obliquely with regard to the impact direction S, note FIGS. 8*a* and 8*b*.

Figure 8C:
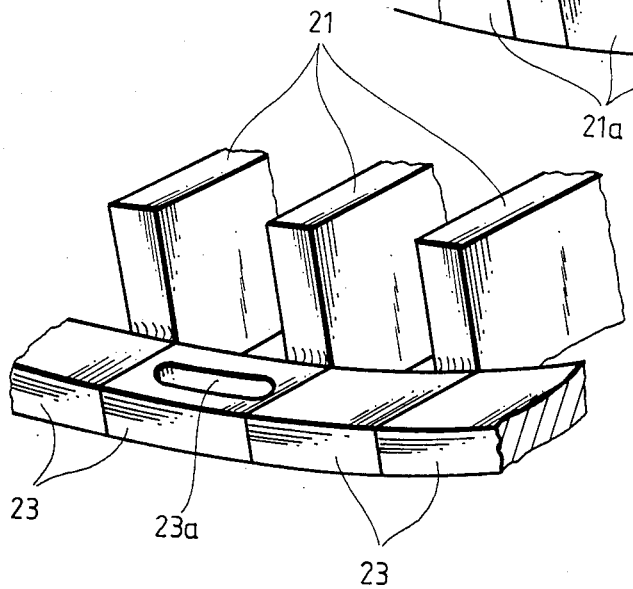

In FIG. 8*c* another embodiment of the rod spacers is exhibited by the rectangular projection members 23 attached to the ends of the grate rods 21 such as by the illustrated welding attachment or by bolting so that the desired spacing between adjacent grate rods is maintained. A groove 23*a* can be provided in each projection member 23, not shown in the drawing, for simplified handling of the individual grate rods. The bolting together of the projection members affords a simple arrangement for their replacement if different dimensions are required so that not only is a rapid replacement available but it is also possible to change the spacing between the individual grate rods.

For the rapid replacement of the individual grate rods, the cross-section and shape of the openings through the outlet grate 14 can be varied to influence the size and/or density of the material being crushed or comminuted. Accordingly, the material to be crushed can be provided with a larger or smaller density or a larger or smaller size in accordance with the grate gap width c and the grate gap shape as determined by the upper dimension b of the spacers 21*a*. In FIG. 8*a* the spacer 21*a* is shown with the upwardly extending face in phantom line so that the face would be recessed inwardly from the surface of the grate rod which cooperates with the crushing tool. In FIG. 8*b* the front face of the spacers is shown recessed inwardly from the face of the rods cooperating with the rotor. This arrangement has the advantage that the spacers are protected against wear caused by the material being crushed contacting the upwardly directed surfaces of the spacers.

In the replaceable grate rods 21 with the stepped projection parts 23, it is possible to increase the width of the projecting part 23 as compared to the corresponding width of the grate rod so that the projecting parts also act as spacers in place of the spacers 21*a*.

While specific embodiments of the invention have been shown and described in detail to illustrate the application of the inventive principles, it will be understood that the invention may be embodied otherwise without departing from such principles.

We claim:

1. Crushing machine comprising a housing having a number of upwardly extending walls forming a crushing space having a lower end and an upper end with said walls including a pair of oppositely spaced first walls, a rotor mounted within said housing for rotation about a horizontal axis and having an axis extending between said first walls, said rotor having a plurality of crushing tools mounted thereon, an inlet in said housing for introducing material to be crushed into said housing, an outlet grate at the lower end of said crushing space below said rotor and extending in the circumferential direction of said rotor and having a circumferential extent, said grate comprising a plurality of grate rods extending parallel to the axis of said rotor, at least one opening in at least one of said first walls in the region of said grate, wherein the improvement comprises that said at least one opening is in at least partial axial alignment with said outlet grate and extends for the circumferential extent of said grate, said outlet grate is supported in said opening and is removable in the axial direction thereof from said housing through said opening, said grate comprises a plurality of rods individually removable through said opening in said housing, means at said opening for securing said rods against displacement in the axial direction of said rotor axis, and means for spacing said grate rods apart in the direction of rotation of said rotor and for varying the impact angles between said grate rods and the material to be crushed.

2. Crushing machine, as set forth in claim 1, wherein said rotor rotates past said grate so that said grate has an upstream and a downstream end relative to the rotational direction of the rotor, at least one web fixed to said first walls of said housing and extending in the axial direction of said rotor and forming a part of said grate, said web is located in a vertical plane including the axis of said rotor.

3. Crushing machine, as set forth in claim 2, wherein said means for spacing comprises that each said individually removable grate rod has at least two spacer members secured thereto and extending from one side of said grate rod in the direction toward the adjacent said grate rod for maintaining the spacing between adjacent said grate rods and determining the width of the gap between said grate rods, and each said spacer member has a surface thereon spaced outwardly from said grate rod and said surface extends obliquely to the surface of said grate rod from which said spacer member extends for varying the impact angles between said grate rods and the material to be crushed.

4. Crushing machine, as set forth in claim 2, wherein an abutment ledge extending in the axial direction of said rotor extends between said first walls and is located at the downstream end of said grate in the direction of rotation of said rotor and bears against the adjacent said grate rod for securing said grate against movement in the rotational direction of said rotor.

5. Crushing machine, as set forth in claim 4, wherein said means for securing said rods comprises at least one cover located on the outside surface of said first wall containing the opening for providing a closure for the opening.

6. Crushing machine, as set forth in claim 1 or 2, wherein said means for securing said rods comprises at least one cover located on the outside surface of said first wall containing the opening for providing a closure for the opening.

7. Crushing machine, as set forth in claim 6, wherein said cover has a projection part extending into the opening in said first wall of said housing into overlapping engagement with said grate rods for limiting displacement of said grate rods in the axial direction of said rotor.

8. Crushing machine, as set forth in claim 7, wherein said grate rods have a groove formed in the end thereof extending into the opening in said first wall of said housing for engaging said projection part on said cover.

9. Crushing machine, as set forth in claim 1, wherein each said removable grate rod has a stepped projection part extending through the opening in said housing, said stepped projection part having a stepped surface bearing against the inside surface of the first wall of said housing in which the opening is formed for limiting displacement of the grate rod in the axial direction of said rotor.

10. Crushing machine, as set forth in claim 9, wherein said projection part of said grate rods has an elongated hole formed therein for receiving a handling tool for removing said individually removable grate rods.

11. Crushing machine, as set forth in claim 1, wherein said means for spacing comprises projection parts extending outwardly from the ends of said grate rods located at said opening, each said projection part extending in the direction of rotation of said rotor from said grate rods to which it is attached into contacting spacing relation with said projection part on one of the adjacent said grate rods.

* * * * *